United States Patent [19]

Thomas

[11] Patent Number: 5,067,193

[45] Date of Patent: Nov. 26, 1991

[54] ROTARY PRINTING PLATE WASHING APPARATUS

[75] Inventor: Daniel J. Thomas, Raleigh, N.C.

[73] Assignee: Container Graphics Corporation, Cary, N.C.

[21] Appl. No.: 558,692

[22] Filed: Jul. 26, 1990

[51] Int. Cl.[5] ..... B08B 11/02; B41N 3/04

[52] U.S. Cl. ..... 15/88.3; 15/77; 15/88; 134/6; 134/10; 134/95; 134/153

[58] Field of Search ..... 15/21.1, 88.1, 88.2, 15/88.3, 88, 77, 102, 40, 63; 134/153, 95, 6

[56] References Cited

U.S. PATENT DOCUMENTS

| | | | |
|---|---|---|---|
| 2,580,344 | 12/1951 | Clayborne | 134/157 |
| 2,721,566 | 10/1955 | Brucker | 134/101 |
| 3,088,391 | 5/1963 | Sigler | 95/93 |
| 3,141,467 | 7/1964 | Robson | 134/58 |
| 3,323,528 | 6/1967 | Link | 134/57 |
| 3,442,251 | 5/1969 | Perkel | 118/9 |
| 3,479,222 | 11/1969 | David et al. | 134/33 |
| 3,573,119 | 3/1971 | Fishaber et al. | 156/14 |
| 4,090,907 | 5/1978 | Anderson | 156/345 |
| 4,299,245 | 11/1981 | Clapper | 134/152 |
| 4,842,001 | 6/1989 | O'Leary | 134/112 |

FOREIGN PATENT DOCUMENTS 493468 6/1953 Canada .

*Primary Examiner*—Edward L. Roberts

*Attorney, Agent, or Firm*—Bell, Seltzer, Park & Gibson

[57] ABSTRACT

The apparatus includes an elongate housing containing a rotatable plate-mounting drum, a reversibly rotatable brush roll, and first and second spray manifolds for respectively spraying fresh water and recirculated water onto the printing plates. The plate-mounting drum may be formed of perforate metal so as to facilitate mounting printing plates thereon. When the printing plate or plates to be cleaned extend longitudinally along only part of the plate-mounting drum, valves associated with the manifolds may be closed to cause water to be discharged only from those manifold sections that confront the printing plates. The fresh water supply circuitry of the apparatus is separate from the circuit for the recirculated water circuitry. A limit switch associated with a housing cover of the apparatus prevents discharge of water from the spray manifolds when the cover is not fully closed. Passive piston and cylinder assemblies assist in movement of the cover portion of the housing from its closed position to an open position, and prevent overly abrupt movement of the cover portion from its open position to its closed position. The spray patterns emitted by laterally adjacent nozzles of the spray manifolds are inclined such that edge portions of laterally adjacent ones of the spray patterns are disposed in overlapping but non-impinging relationship to each other. The spray manifolds are mounted within a pivotally movable housing cover of the apparatus, so as to be readily accessible for purposes of cleaning and/or repair.

19 Claims, 6 Drawing Sheets

WASH WATER
FILL/RINSE

START SWITCH
114
CAM TIMER CONTROL
120
LATCHING RELAY
CYCLE "ON"
COVER L.S.
28
EMERGENCY STOP
117
COVER "OPEN"
BRUSH DURATION SWT.
113
24v
OUT
A.C. POWER SOURCE
TRANS.
112
FOOT SWT.
CYCLE COMPLETE
MOTOR STARTER
PLATE DRUM
DRUM MOTOR
38
BRUSH
REV. RELAY
BRUSH MOTOR
52
PUMP MOTOR
96
99
SOL
DRAIN VALVE (N/O)
82
WATER-IN VALVE (N/C)
FILL/RINSE

ROTARY PRINTING PLATE WASHING APPARATUS

FIELD OF THE INVENTION

This invention relates to an improved apparatus and method for cleaning semi-flexible arcuate printing plates made of rubber or a photopolymer and used for printing indicia upon paper board cartons, boxes and the like.

BACKGROUND OF THE INVENTION

As is well known to those skilled in the art, printing plates of the aforesaid type must be periodically cleaned in order to maintain satisfactory printing quality. Such cleaning is now customarily performed either by hand or by an apparatus having a plate supporting frame upon which the plates to be cleaned are placed in a semi-flattened condition. The apparatus further includes a reciprocating spray assembly that sprays water or other cleaning fluid downwardly upon the plates upon the bed as the assembly reciprocates to and fro above them. The aforesaid apparatus does not always clean the plates as rapidly or thoroughly as desired. Most importantly, deforming of the plates to a flattened condition during cleaning significantly decreases their useful life.

Other apparatuses previously used primarily for etching, but in some cases also for washing, arcuate printing plates include elongate rotatable cylinders or drums upon which the plates are mounted. These apparatuses impose less bending stress upon the plates during mounting and customarily include one or more spray assemblies that direct water or other cleaning fluid onto the plates mounted upon and rotatable in unison with the drums. The apparatuses may include a brush that also engages the rotating plate for the purpose of assisting in their cleaning. Prior U.S. patents disclosing apparatuses of the foregoing general type include U.S. Pat. Nos. 4,090,907, 3,573,119, 3,323,528 and 3,088,391. Other prior U.S. patents of possible interest relative to the present invention include U.S. Pat. Nos. 4,842,001, 3,479,222, 3,442,251, 3,141,467 and 1,106,795.

SUMMARY OF THE INVENTION

The present invention provides an improved plate washing apparatus of the type having a substantially cylindrical drum upon which the plates are mounted and by which they are caused to undergo rotary movement as a cleaning fluid, such as water, is sprayed upon them. The water supply and drain means of the apparatus preferably are so constructed as to prevent ink contaminated water from entering the clean water supply source associated with the apparatus or from overflowing onto the floor of the work area in which the apparatus is located, and so as to permit use of a reduced quantity of water in appropriate plate washing operations. The apparatus further includes means for enhancing the ease, rapidity and safety with which the printing plates can be mounted within and subsequently removed from the apparatus by an operator. Such means preferably includes a shock-proof switch by which the operator can, even in a wet environment, safely impart "inching" rotary movement to the plate supporting drum of the apparatus during plate mounting and demounting; piston and cylinder assemblies that facilitate the ease and safety of operator movement of a housing cover of the apparatus between open and closed positions; and a limit switch that prevents water spray assemblies within the housing from spraying fluid upon the operator. The means employed in the apparatus for achieving rapid and thorough cleaning of the plates preferably includes a plate engaging rotary brush which during each cleaning operation is rotated in first and second opposite directions, and spray assemblies which are mounted within the movable housing cover portion of the apparatus, and that produce laterally adjacent fanshaped spray patterns that overlap with, but do not impinge upon, each other.

DESCRIPTION OF THE DRAWINGS

Other features of the invention will be apparent from the following description of an illustrative embodiment thereof, which should be read in conjunction with the accompanying drawings, in which.

DESCRIPTION OF THE ILLUSTRATED EMBODIMENTS

Figure 3:
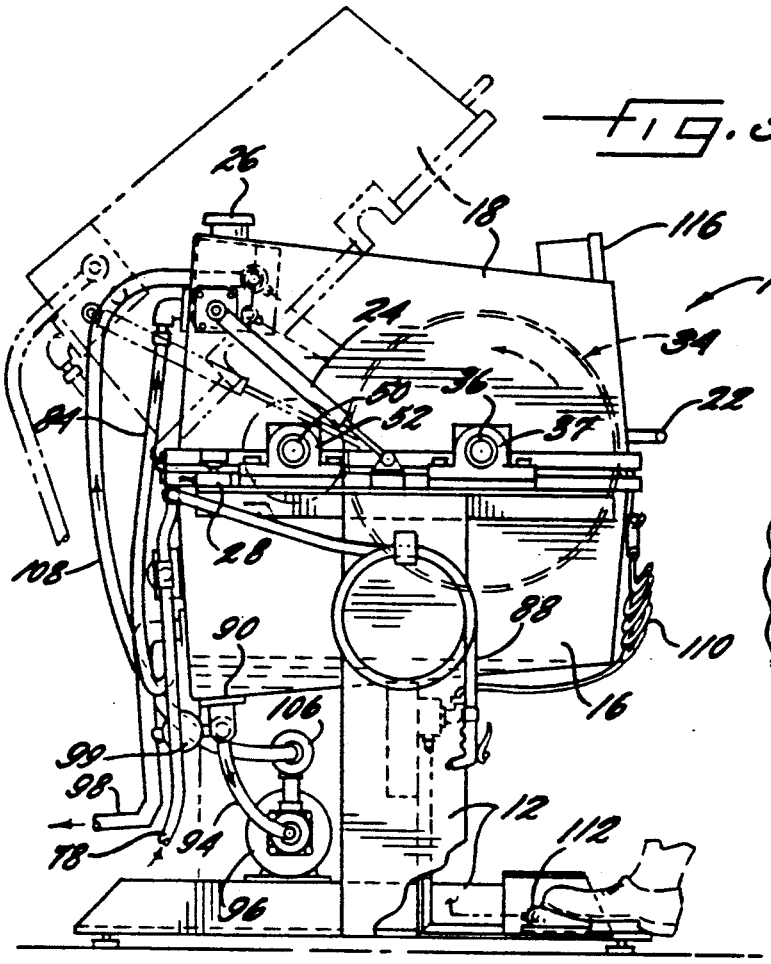
FIG. 3 is an end view, taken in the direction of the arrows 3—3 of FIG. 1, wherein phantom lines show a housing cover of the apparatus in an open position and also show a switch engaging foot of an operator of the apparatus.
Figure 4:
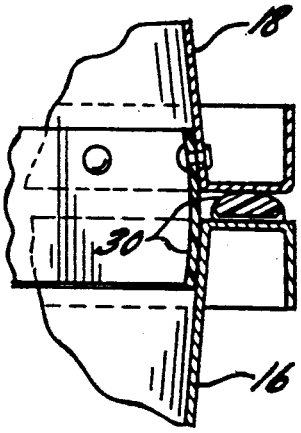
FIG. 4 is an enlarged fragmentary sectional view taken in the direction of the arrows 4—4 of FIG. 1 and showing seals between upper and lower sections of the housing of the apparatus.
Figure 5:
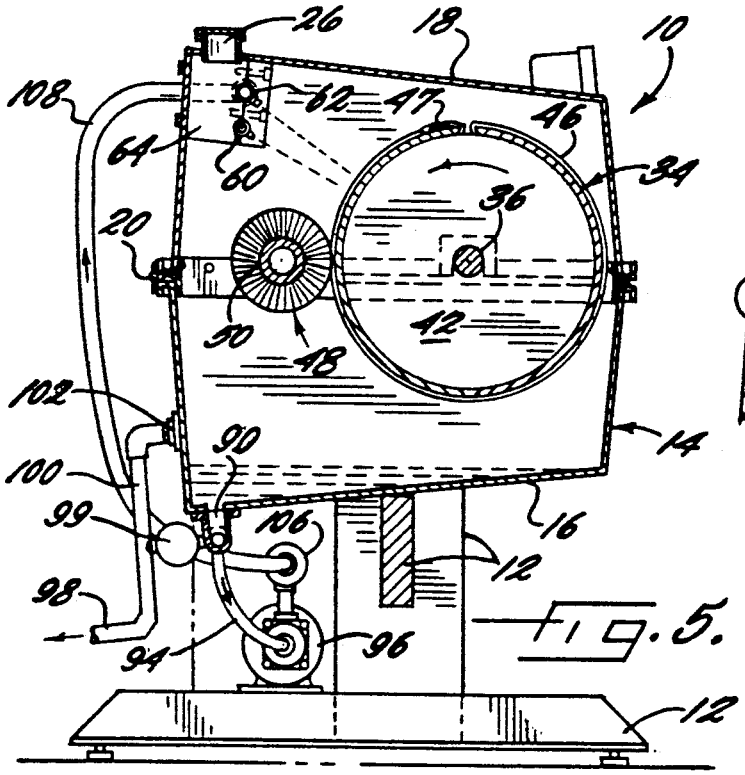
FIG. 5 is a view primarily in transverse section but with some components being shown in side elevation, taken substantially along the line and in the direction of the arrows 5—5 of FIG. 2.

The printing plate washing apparatus designated in its entirety by the numeral 10 in FIGS. 1-3 and 5 has an upstanding floor-engaging frame 12 that supports an elongate generally horizontally extending housing 14. Housing 14 has a trough-like lower section 16 and an upper cover section 18. Cover section 18 is pivotally connected along its rear edge to lower section 16, as by hinge means 20 (FIG. 2), for pivotal movement between open and closed positions respectively shown by phantom and solid lines in FIG. 3. A handle 22 upon the front wall of cover 18 facilitates movement of the cover between its aforesaid positions. Passive pneumatic piston and cylinder assemblies 24 interconnect lower and upper portions 16, 18 of housing 14 adjacent opposite ends thereof. Assemblies 24 assist operator movement of cover 18 from its closed position to its open position, and prevent overly abrupt reverse movement of cover 18 from its open position to its closed position. The assemblies thus contribute to the ease and safety of operation of apparatus 10. Detergent or the like may if desired be introduced into housing 14 via a port 26, upon removal of a lid associated therewith, provided upon upper housing portion 18. A limit switch 28, best shown in FIG. 3, is actuated upon initial pivotal movement of housing cover portion 18 from its closed position toward its open position. Switch 28 prevents water from being sprayed from subsequently described spray assemblies of the apparatus when housing cover 18 is not fully closed. Seals 30 (FIG. 4) carried by confronting portions of housing portion 16, 18 prevent passage of liquid from the housing through the spaces between its aforesaid portions when cover portion 18 occupies its closed position.

An elongate cylindrical drum 34, which has a center shaft 36, is mounted within housing 14 by suitable bearings 37 for rotation about the substantially horizontal central axis of shaft 36. Drum 34 extends substantially the entire length of housing 14, is approximately equidistant from the upper and lower extremities of the housing, and is located in a forward-rearward direction adjacent the front of the housing. Rotary movement is imparted to drum 34, in the direction of the arrows shown in FIGS. 3 and 5 and at desired times, by a drive motor 38 (FIG. 1) and associated gear box 40 connected to one end of drum shaft 36 and located within an auxiliary housing 41 of apparatus 10. In addition to functioning as a transmission, gear box 40 acts as a brake means to promptly halt rotation of drum 34 upon deenergization of drive motor 38. Disc-like spacers 42 interconnect shaft 36 and the outer cylindrical wall of drum 34. A plurality of slots 44 extend longitudinally of the cylindrical outer wall of drum 34 at circumferentially spaced locations thereon.

Figures 7, 7A:
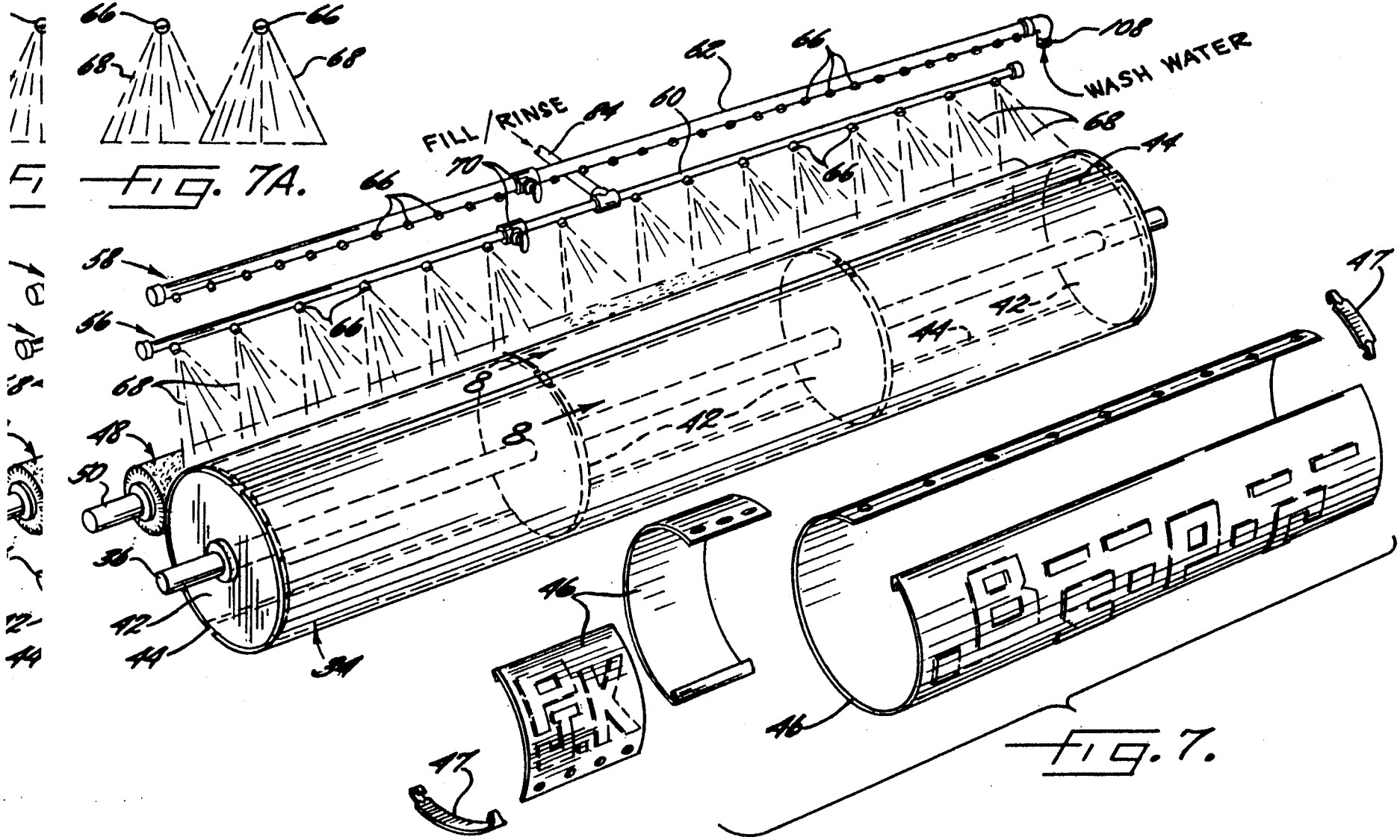
FIG. 7 is a perspective view of a plate mounting drum of the apparatus, of printing plates and retaining straps mountable upon the drum, and of spray manifolds and a brush roll adjacent the drum.
FIG. 7A is an enlarged front elevational view of spray nozzles and patterns of the spray manifolds.
Figure 8:
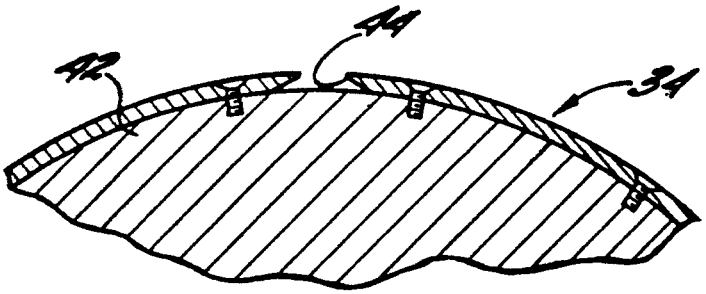
FIG. 8 is a fragmentary enlarged sectional view, taken substantially along the line and in direction of the arrows 8—8 of FIG. 7, of a plate mounting slot within the plate mounting drum.
Figure 9:
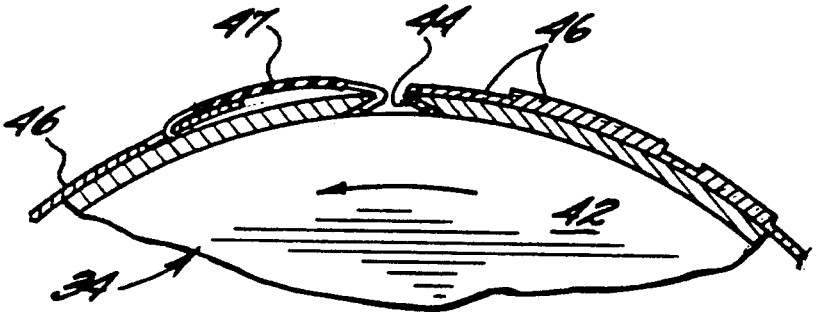
FIG. 9 is a view similar to FIG. 8 but also showing fragmentary portions of a printing plate and of a plate retaining strap upon the drum.

The numeral 46 in FIG. 7 designates arcuate printing plates cleanable by apparatus 10. The plates customarily are made of either rubber or photopolymer. The rubber plates are more durable than those made of photopolymer, but are more difficult to clean. One or more of plates 46 to be cleaned, are mounted upon drum 44 by inserting the reversedly bent one of the longitudinally extending edge portions of each printing plate into any conveniently accessible one of the drum slots 44, and then connecting the perforated other longitudinal edge portion of the arcuate plate to the drum by one or more straps 47. Each strap 47 has a hook at one end that is received within one of the apertures adjacent the plate edge, and a hook at its opposite end that is received within one of the drum slots 44. In addition to providing "anchor" locations for mounting of printing plates 46 upon drum 34, slots 44 permit any liquid entering into drum 34 to pass outwardly therefrom into lower housing portion 16. A plurality of printing plates 46, of either equal or different arcuate dimensions, may be simultaneously mounted upon in laterally adjacent relationship to each other upon drum 44. Preferably, however, the plates washed during each operation should all be of either the rubber type, or all the photopolymer type, and not of mixed types.

A cylindrical brush roll 48 having a center shaft 50 is mounted within housing 14 by bearings 52. Roll 48 is located in closely spaced substantially parallel relationship to drum 34, and is of substantially the same axial length as the drum. The periphery of the brush roll engages any plates 46 upon drum 34, and the speed of rotation of roll 48 preferably is faster than that of drum 44. Rotative movement is imparted to brush roll 48, at desired times and in desired ones of opposite rotative directions, by a reversible motor 54 (FIG. 2) located within auxiliary housing 41 of apparatus 10. The bearings 37, 52 that respectively support drum 34 and brush roll 48 preferably and illustratively are affixed to and supported by frame 12, as shown in the drawings, rather than to housing 14 of apparatus 10. The central axes of drum 34 and roll 48 are closely adjacent the generally horizontal plane containing the upper surface of lower housing portion 16.

Figure 6:
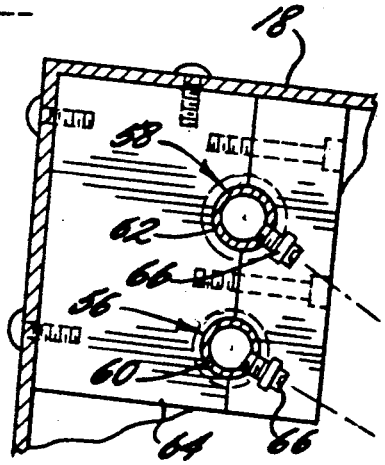
FIG. 6 is an enlarged fragmentary sectional view, taken substantially along the lines and in the direction of the arrows 6—6 of FIG. 2, of spray manifolds and associated nozzles within the upper cover section of the housing of the apparatus.

Apparatus 10 also includes means for at desired times during operation of apparatus 10 spraying plate cleaning fluid, illustratively water, upon printing plates 46 mounted upon drum 34. The spray means includes first and second spray assemblies 56, 58 respectively having elongate tubular spray manifolds 60, 62 that are fixedly mounted within the upper rear area of housing cover 18 by laterally spaced mounting plates 64 (FIG. 6). Manifolds 60, 62 extend substantially the entire length of housing 14 in substantially parallel relationship to each other and to the longitudinal axes of drum 34 and brush roll 48. At spaced locations along the length thereof, each manifold 60, 62 has a plurality of spray nozzles 66, there illustratively and preferably being a greater number of such nozzles upon upper manifold 58 than upon lower manifold 56. Each nozzle 66 has a slot-like fluid outlet that creates a diverging, generally fan-shaped spray pattern 68. As is indicated in FIG. 7A, the spray patterns 68 created by the nozzles 66 of each manifold 60 or 62 are laterally tilted slightly relative to a plane containing the central axes of the nozzles, so as to cause adjacent ones of the patterns to overlap without impinging upon each other. When housing cover 18 occupies its closed position of FIG. 5, the fluid sprayed from manifolds 60, 62 impinges substantially radially upon drum 34, and any printing plate or plates 46 carried thereby, at a location preferably and illustratively above brush roll 48 and below the upper extremity of drum 34. When cover 18 occupies its fully open position shown by phantom lines in FIG. 3, nozzles 66 extend generally horizontally and are readily accessible for purposes of cleaning, replacement or repair.

Normally open valves 70 may be and illustratively are provided approximately midway the length of manifolds 60, 62. Closure of such valves restricts passage of water into, and thus spraying of water from, the sections of manifolds to the left (as viewed in FIG. 7) of the valves. When the printing plate or plates 46 to be washed during a cycle of operation of apparatus 10 can be and are all mounted upon the right end section of drum 34, valves 70 may be closed to reduce to the amount of water used during the plate cleaning operation.

Figures 1, 2:
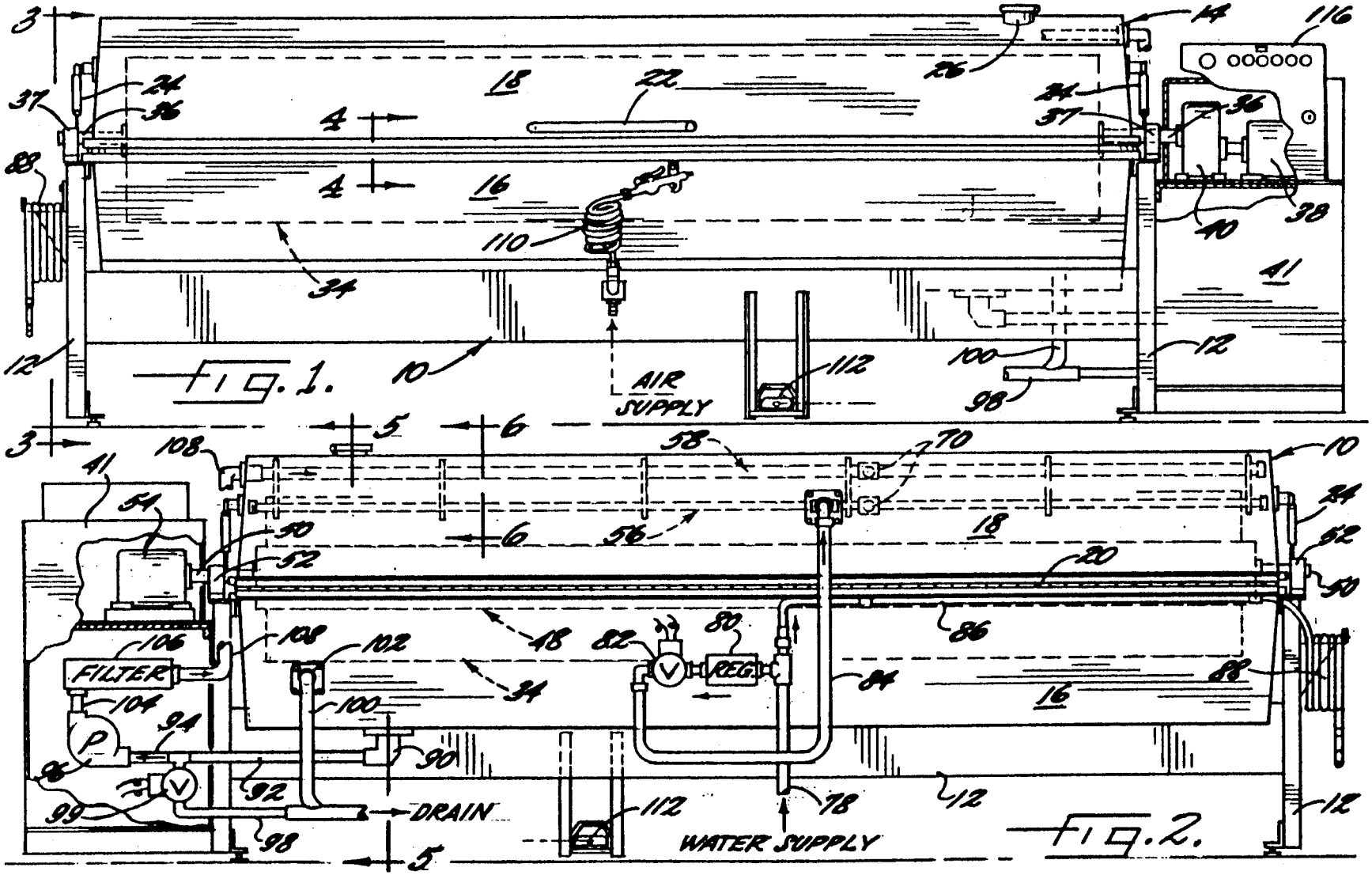
FIG. 1 is a front elevational view of a printing plate washing apparatus in accordance with the invention.
FIG. 2 is a rear elevational view of the apparatus.

The spray assembly 56, of which manifold 60 forms a part, receives only clean water. Such water is conducted to manifold 60 from a suitable source, such as a city water main (not shown) via a fluid supply circuit that includes water supply pipe 78, a flow regulator 80, an electrically operated valve 82, and a flexible pipe 84 that extends from the outlet of valve 82 through the rear wall of cover 18 of housing 14, and then to manifold 60. As is also indicated in FIG. 2, a branch line 86 conducts water from supply pipe 78 to a flexible hose 88, having a manually-operated valve at its free end, that may be used by an operator of apparatus 10 for clean-up and other purposes. Regulator 80 ensures that the desired quantity of water is introduced into manifold 60, at those times when valve 82 is open, notwithstanding possible fluctuations in the pressure of the water within water supply pipe 78.

Manifold 62 of the other spray assembly 58 is separate from the above-discussed circuit that supplies clean water to manifold 60. Manifold 62 receives and discharges, at desired times during each cycle of operation of apparatus 10, water previously introduced into housing 14 via spray manifold 60. The fluid circuit by which such water is recirculated at desired times to manifold 62 is best shown in FIG. 2. Such circuit includes a drain 90 connected to the bottom of lower housing section 16 of apparatus 10. A pipe 92 connected to drain 90 has a first branch 94 leading to a high pressure pump 96. A second branch 98 contains a normally open electrically operated valve 100 and leads to a sewer, sump or other site (not shown) into which ink-containing fluid may be discharged without adverse environmental consequences. At a location downstream from valve 99, a conduit 100 interconnects pipe 98 and an overflow drain 102 that communicates with lower housing section 16 at an elevation above the bottom of such housing section but below the elevation of drum 34. When valve 99 is closed, water passing through drain 90 and pipe 92 is conducted via branch pipe 94 to pump 96, which when actuated then pumps such fluid to manifold 62 via a pipe 104, filter 106 and flexible pipe 108 that communicates at its upper end With one end of the manifold. Due to its being under substantially greater pressure, the recirculated water discharged from manifold 62 subjects plates 46 to a more forceful cleaning action than does the lower pressure fluid sprayed onto the plates by manifold 60.

A flexible air line 110 (FIG. 1) connected to a suitable source (not shown) of compressed air preferably is provided upon the front of lower housing portion 16. Line 110 has a manually operated valve at its free end, and is usable by an operator of apparatus 10 for cleaning and/or drying purposes.

Figure 10:
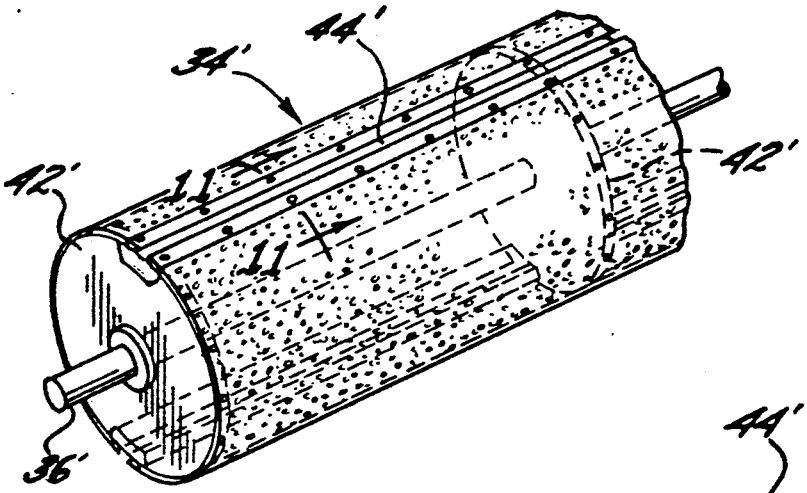
FIG. 10 is a fragmentary perspective view of another embodiment of the plate mounting drum of the apparatus, wherein the cylindrical wall of the drum is perforated.
Figure 11:
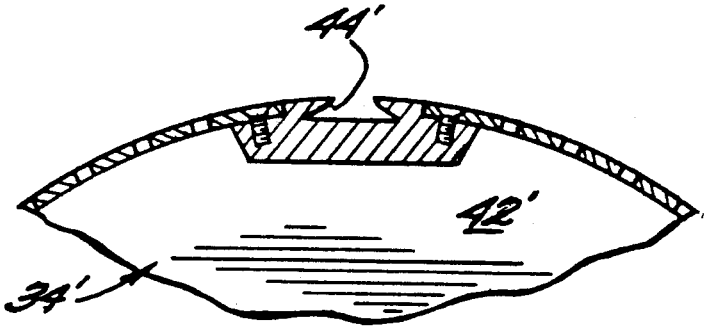
FIG. 11 is a fragmentary enlarged transverse sectional view taken in the direction of the arrows and approximately along the line 11—11 through the perforated drum of FIG. 10.

FIGS. 10 and 11 of the drawings show an alternative embodiment wherein the cylindrical wall of the illustrated plate-mounting drum 34' has perforations extending therethrough. In addition to facilitating more rapid drainage of water from the interior of drum 34', the perforations are of such size as to readily receive the hooks upon the plate-mounting straps 47 (FIG. 7). This facilitates the ease and speed with which plates 46 may be mounted upon drum 34', and also reduces the number of longitudinally extending slots 44' that need be provided in the drum.

The ease and safety by which printing plates 46 may be mounted by an operator upon drums 34 or 34' is also enhanced by the provision of a pneumatic bellows-type, foot-operated switch 112 (FIGS. 1–3) located adjacent the bottom-front portion of apparatus 10 for convenient actuation by the foot of an operator of the apparatus. Switch 112 is not affected by cover limit switch 28, and is used when printing plates 46 are being mounted upon or demounted from drum 34 or 34'. By intermittently depressing and releasing bellows switch 112 with his foot, an operator causes the drum drive means to impart controlled "inching" or "jogging" limited rotary movement to drum 34 or 34' as he mounts each printing plate 46 upon the drum. The use of a bellows-type pneumatic switch 112, rather than an electrical one, ensures that an operator will not receive electrical shock when using such switch, even in wet ambient conditions. Operator safety during mounting of plates 46 upon the drum is further increased by the fact that the drum rotation is in the "rearward" direction indicated by the arrow in FIG. 5, and ceases promptly upon deenergization of the drum drive means.

Figure 12:
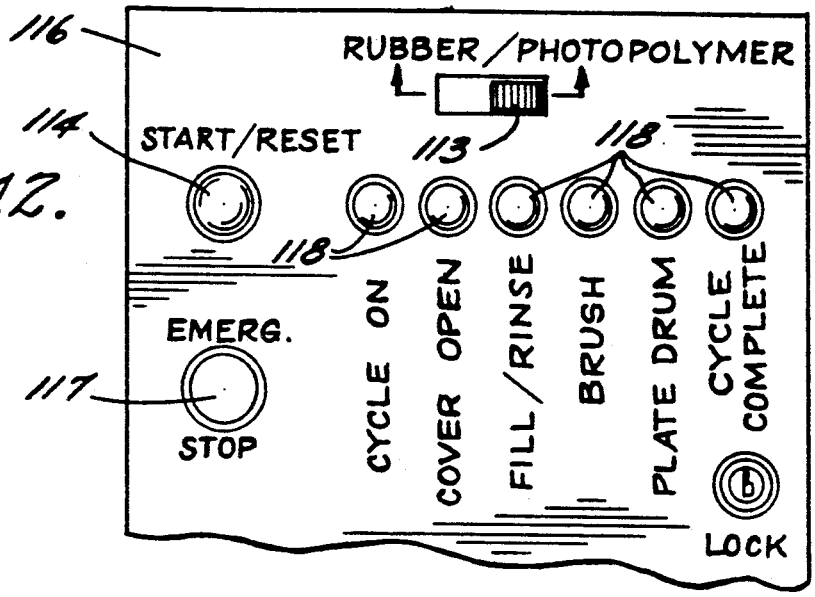
FIG. 12 is a diagrammatic representation of a portion of a control panel of the apparatus.
Figure 13:
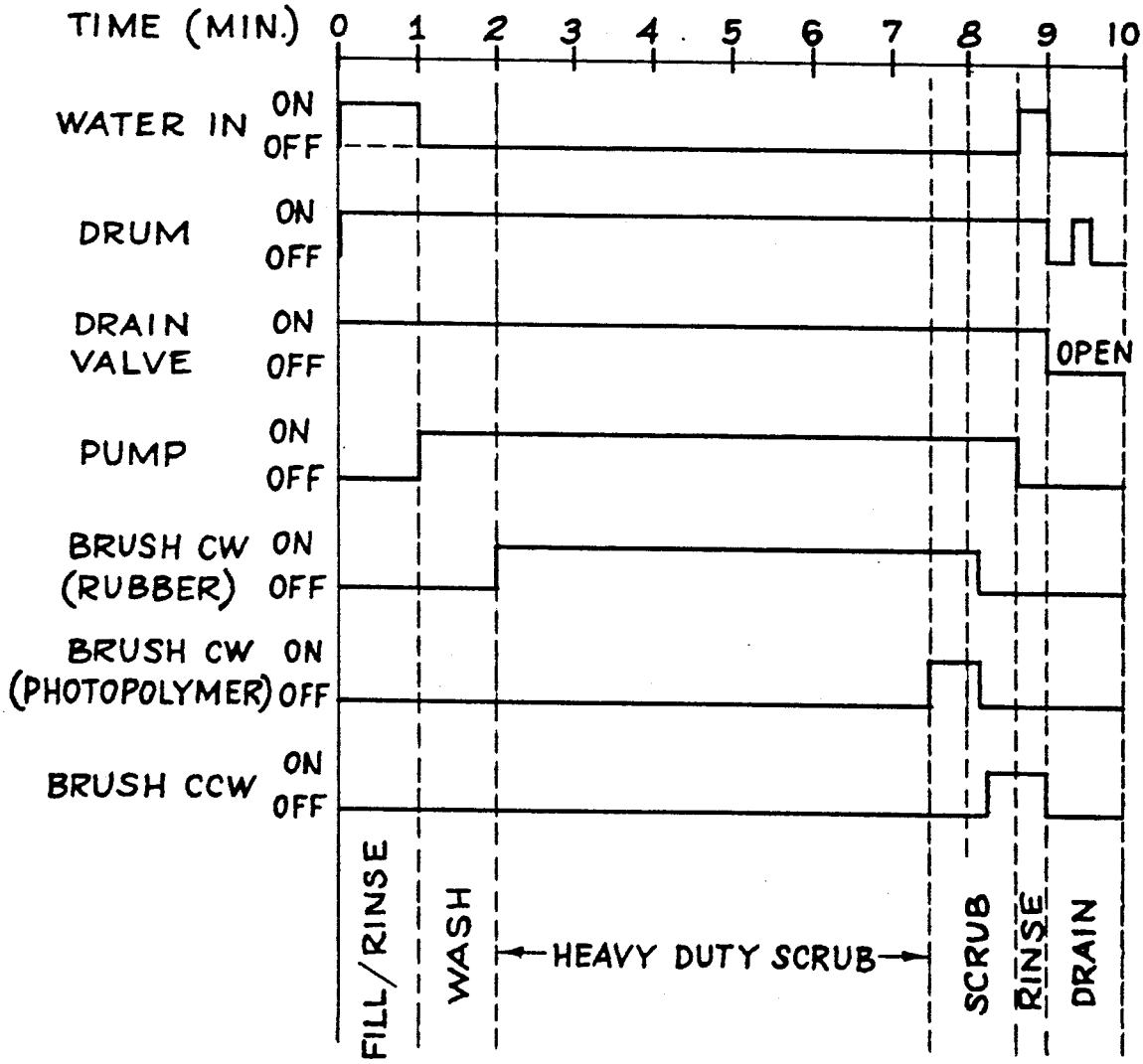
FIG. 13 is a diagram illustrating the timing of a cycle of operation of the apparatus.
Figure 14:
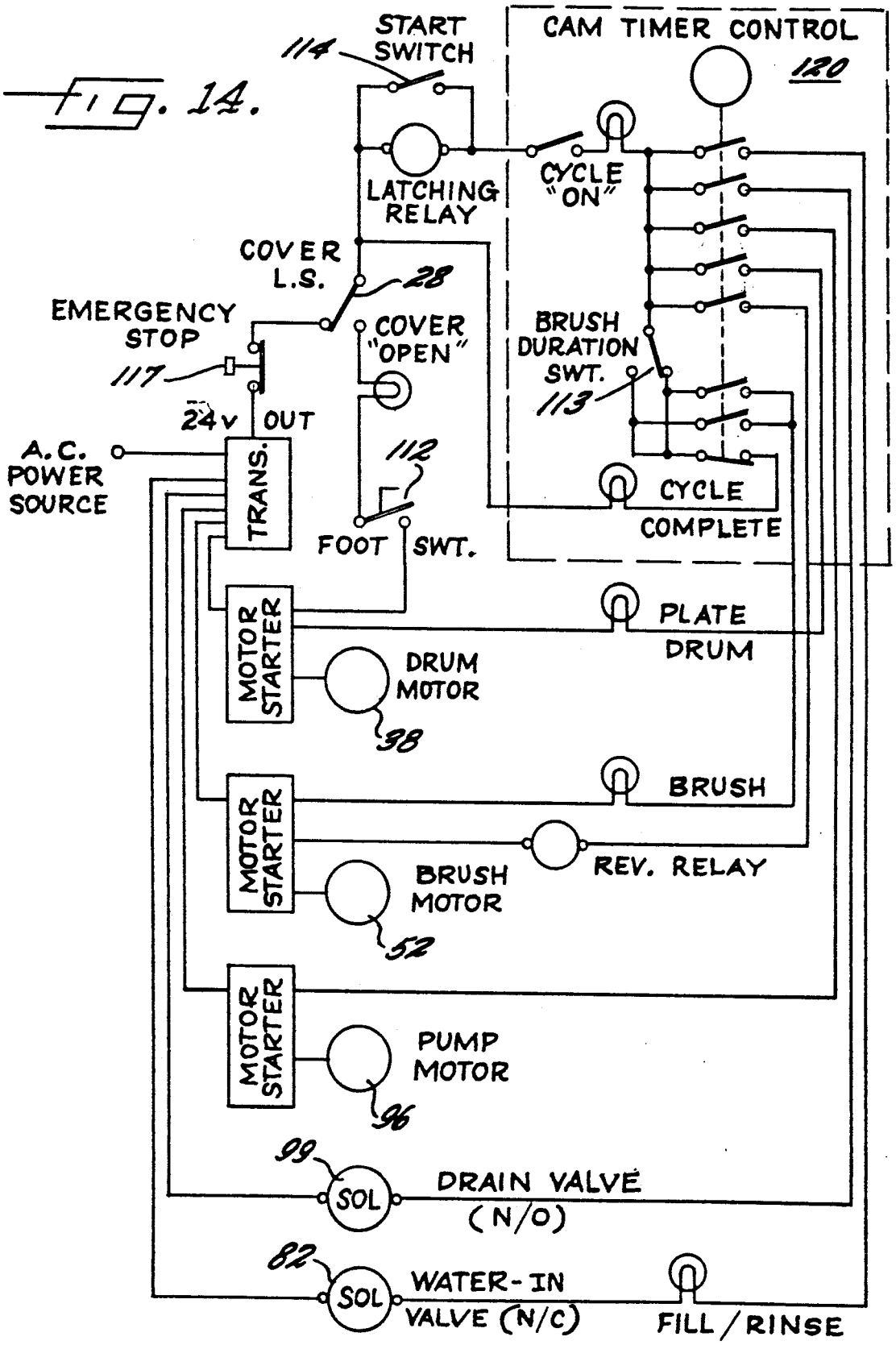
FIG. 14 is a schematic diagram of an electrical control circuit for the apparatus.

Referring now particularly to FIGS. 12–14 of the drawings, a control panel 116 upon auxiliary housing 41 includes a "rubber/photopolymer" switch 113, a "start/reset" switch 114, and an "emergency/stop" switch 117. Switch 113 is placed by the operator of apparatus 10, prior to the commencement of a cycle of operation of the apparatus, in its "rubber" position if the printing plates to be washed are made of rubber, instead of photopolymer. This causes the duration of a "scrub" stage of the cleaning operation, during which brush roll 48 is driven, to be substantially longer than when switch 113 occupies its "photopolymer" position. Switches 114, 117 are used by the operator to respectively initiate an automatic cycle of operation of apparatus 10, and to halt its operation if an emergency should arise. In addition to the aforesaid switches, control panel 16 mounts a plurality of indicator lights 118 which advise the operator of such things as when an automatic cycle of operation of the apparatus is in progress, when housing cover 18 is not fully closed, when fresh water is being introduced into the apparatus, when brush roll 48 and drum 34 are undergoing rotation, and when a cycle of operation of the apparatus has been completed. Premature cessation of any cycle of operation in the apparatus occurs if the emergency stop switch 117 is actuated, or if the limit switch 28 (FIG. 3) signals that housing cover 18 is not fully closed. Resumption of an interrupted cycle of operation of the apparatus ensues upon the operator's actuation of start/ reset switch 114 and, if the interruption was occasioned by limit switch 28, by closure of housing cover 18. An electrical control circuit, which includes a cam timer 120, for producing the aforesaid automatic operation of apparatus 10 is schematically shown in FIG. 14 of the drawings. Other circuitry similarly capable of producing automatic operation of the apparatus may be employed in lieu thereof, however.

An illustrative ten-minute cycle of automatic operation of apparatus 10 is illustrated by the timing diagram of FIG. 13 of the drawings. During the initial "fill/rinse" stage of operation, the water control valve 76 passes clean water to lower spray manifold 56, which sprays such water onto the plates 46 upon drum 34 or 34' as the drum undergoes rotation. Brush roll 48 remains stationary. Normally open drain valve 99 (FIG.

2) is activated so as to prevent the water introduced into apparatus 10 during each cycle of operation from being prematurely discharged into the pipe 98 leading to a sewer or sump.

After a period of time sufficient for introduction of the desired quantity of water into apparatus 10, fresh water control valve 82 closes and pump 96 is energized. During this "wash" phase of operation, the water within lower housing section 16 of the apparatus is recirculated by drain 90, pipes 92, 94 and pump 96 through filter 106 and pipe 108 to upper spray manifold 62. It is then sprayed under relatively high pressure onto the printing plates 46 upon the rotating drum 34.

Pump 96 continues to operate during the next ensuing "scrub" phase of operation. Brush roll 48 rotates in a clockwise direction. The duration of the roll's rotation is dependent upon the preset position of control switch 113 (FIGS. 12 and 14), and is much greater when the switch occupies its "rubber" position. Rotation of the brush produces a scrubbing action that assists in dislodging dried ink and the like from "shielded" and other "problem" areas upon the printing plates. Near the end of the "scrub" phase of operation, the direction of rotation of brush 48 reverses.

During the next ensuing "rinse" phase of operation, pump 96 is deactivated. Control valve 82 is open, causing clean "rinse" water to again be sprayed onto printing plates 46 from lower spray manifold 60. Rotation of brush roll 48 changes from clockwise to counterclockwise, and then ceases.

At the outset of the final "drain" phase of operation of apparatus 10, fresh water control valve 82 closes, drain valve 99 opens, and rotation of drum 34 or 34' and brush roll 48 ceases. As water drains from housing 14, drums 34, 34' again rotates briefly for the purpose of hastening drying of the printing plates 46 thereon.

While a preferred embodiment of the invention has been shown and described, this was for purposes of illustration only, and not for purposes of limitation, the scope of the invention being in accordance with the following claims.

I claim:

1. Apparatus for washing arcuate printing plates, comprising:

an elongate housing, said housing including a lower trough-like section, and an upper cover section mounted for movement between a closed position wherein said cover section overlies said trough-like section and an open position wherein said cover section permits access to the interior of said housing;

an elongate plate supporting drum mounted within said housing for rotation about its longitudinal axis, said drum being adapted to support at least one printing plate upon its peripheral surface;

drive means for imparting said rotation to said drum, and to a printing plate supported thereon;

a source of clean plate washing fluid;

a fluid spray manifold connected to said fluid source, said spray manifold being mounted within and movable with said cover section of said housing, and at desired times spraying fluid from said source onto a printing plate supported by said drum; and a brush mounted within said housing in generally parallel adjacent relationship to said plate supporting member, said brush being engageable with the printing plate carried by said drum.

2. Apparatus as in claim 1, and further including brush drive means for at desired times rotating said brush in first and second different directions.

3. Apparatus as in claim 1, and further including a second spray manifold mounted within said cover section of said housing in laterally spaced parallel relationship to said first manifold, said spray manifolds each having a plurality of spray nozzles spaced along the length thereof.

4. Apparatus as in claim 3, and further including valves intermediate the length of said manifolds, each of said valves when in an open condition permitting fluid flow through substantially the entire length of the associated one of said manifolds, and when in a closed position permitting fluid flow through only part of the length of said manifold.

5. Apparatus as in claim 3, wherein laterally adjacent ones of said nozzles of each of said manifolds produce diverging and laterally overlapping fan-shaped spray patterns that are spaced from each other.

6. Apparatus as in claim 5, wherein the number of said nozzles upon said first-mentioned one of said manifolds is less than the number of said nozzles upon said second one of said manifolds.

7. Apparatus as in claim 3, wherein said nozzles extend substantially radially relative to said central axis of said drum and to printing plates mounted upon said drum.

8. Apparatus as in claim 3, and further including a fluid circuit for recirculating to said second manifold fluid introduced via said first manifold into said housing.

9. Apparatus as in claim 8, wherein said fluid circuit includes a pump for conducting the recirculated fluid under pressure to said second manifold.

10. Apparatus as in claim 9, wherein said circuit includes a filter for filtering the recirculated fluid prior to its introduction into said second manifold.

11. Apparatus as in claim 10, wherein said fluid circuit includes a drain adjacent the bottom of said housing, and further including an overflow drain communicating with said housing at an elevation above said first-mentioned drain.

12. Apparatus as in claim 11, wherein said fluid circuit includes a valve for, in a first operating condition, permitting passage of fluid from said first-mentioned drain to said pump, and in a second operating condition preventing passage of fluid from said drain to said pump.

13. Apparatus as in claim 12, wherein the speed at which said brush is rotated by said drive means associated therewith is greater than that at which said drum is rotated by said drive means associated with said drum.

14. Apparatus as in claim 3, including switch means for preventing operation of said spray manifolds except when said cover section of said housing occupies a closed position.

15. Apparatus as in claim 1, and further including a drain communicating with said lower section of said housing at a first elevation adjacent the bottom of said lower section of said housing, and a second drain communicating with said lower section of said housing at an elevation below that of said drum and above said first elevation.

16. Apparatus as in claim 1, and further including piston and cylinder assemblies connected to said cover section of said housing for facilitating movement thereof from said closed position to said open position.

17. Apparatus as in claim 16, and further including seal means connected to said sections of said housing for minimizing passage of fluid from between said housing sections when said cover section is in its closed position.

18. Apparatus for washing arcuate printing plates, comprising:

an elongate housing having a cover section movable between an open and a closed position;

an elongate plate supporting drum mounted within said housing for rotation about its longitudinal axis, said drum being adapted to support at least one printing plate upon its peripheral surface;

drive means for imparting said rotation to said plate supporting drum, and to a printing plate supported thereon;

a source of clean plate washing fluid;

a fluid spray manifold mounted upon said cover section of said housing in laterally spaced and generally parallel relationship to said drum, said assembly being connected to said fluid source and at desired times spraying fluid from said source onto a printing plate supported by said drum; and a valve intermediate the length of said manifold, said valve when in an open condition permitting passage of said fluid from said source through the length of said manifold, and said valve when in a closed position preventing passage of said fluid through a longitudinal section of said manifold.

19. Apparatus as in claim 18, and further including a second spray manifold mounted within said housing, said second manifold being mounted upon said cover section of said housing and receiving only fluid introduced into said housing via said first manifold and recirculated to said second manifold.

* * * * *